US011851735B2

(12) United States Patent
Li et al.

(10) Patent No.: US 11,851,735 B2
(45) Date of Patent: Dec. 26, 2023

(54) HIGH-STRENGTH AND DUCTILE MULTICOMPONENT PRECISION RESISTANCE ALLOYS AND FABRICATION METHODS THEREOF

(71) Applicant: Central South University, Changsha (CN)

(72) Inventors: Zhiming Li, Changsha (CN); Shuya Zhu, Changsha (CN); Dingshun Yan, Changsha (CN); Kefu Gan, Changsha (CN); Yong Zhang, Changsha (CN)

(73) Assignee: Central South University, Changsha (CN)

( * ) Notice: Subject to any disclaimer, the term of this patent is extended or adjusted under 35 U.S.C. 154(b) by 0 days.

(21) Appl. No.: 18/004,662

(22) PCT Filed: Jun. 7, 2022

(86) PCT No.: PCT/CN2022/097459
§ 371 (c)(1),
(2) Date: Jan. 6, 2023

(87) PCT Pub. No.: WO2023/050860
PCT Pub. Date: Apr. 6, 2023

(65) Prior Publication Data

US 2023/0257855 A1 Aug. 17, 2023

(30) Foreign Application Priority Data

Sep. 30, 2021 (CN) ..... 202111158979.1

(51) Int. Cl.
*C22C 19/05* (2006.01)
*C22F 1/10* (2006.01)
*C22C 1/02* (2006.01)

(52) U.S. Cl.
CPC ..... *C22C 19/058* (2013.01); *C22C 1/023* (2013.01); *C22F 1/10* (2013.01)

(58) Field of Classification Search
CPC ... C22C 19/056; C22C 19/055; C22C 19/058; C22F 1/10
See application file for complete search history.

(56) References Cited

U.S. PATENT DOCUMENTS

2010/0296962 A1* 11/2010 Hasselqvist ..... C22C 19/056 420/445
2019/0071755 A1 3/2019 Lee et al.

FOREIGN PATENT DOCUMENTS

| | | | |
|---|---|---|---|
| CN | 109252083 | A | 1/2019 |
| CN | 111363952 | A | 7/2020 |
| CN | 112322940 | A | 2/2021 |
| CN | 112322957 | A | 2/2021 |
| CN | 113930642 | A | 1/2022 |
| JP | 2011162803 | A | 8/2011 |
| SU | 1233808 | A3 | 5/1986 |

OTHER PUBLICATIONS

International Search Report and Written Opinion of the corresponding PCT application No. PCT/CN2022/097459 dated Sep. 6, 2022.
Kao et al., Electrical, magnetic, and Hall properties of AlxCoCrFeNi high-entropy alloys, Journal of Alloys and Compounds, vol. 509, Issue 5, Feb. 3, 2011, pp. 1607-1614.
Swe-Kai Chen and Yih-Farn Kao, Near-constant resistivity in 4.2-360 K in a B2 Al2.08CoCrFeNi, AIP Advances 2, 012111 (2012).
Zhi-Ming Jiao et al., Plastic Deformation of Al0.3CoCrFeNi and AlCoCrFeNi High-Entropy Alloys Under Nanoindentation, Journal of Materials Engineering and Performance vol. 24, pp. 3077-3083 (2015).

* cited by examiner

*Primary Examiner* — Jessee R Roe
(74) *Attorney, Agent, or Firm* — Idea Intellectual Limited; Margaret A. Burke; Sam T. Yip

(57) ABSTRACT

A type of high-strength and ductile multicomponent precision resistance alloys and fabrication methods thereof are provided. The alloys are composed of the following components by atomic percentage: Ni 45-60%, Cr 15-30%, Fe 5-20%, Al 5-15%, Mn 3-5%, Cu 0.2-3%, Si 1-5%. Particularly, the sum of the atomic percentages of Mn, Cu and Si is ≤13% and ≥4.2%, the sum of the atomic percentages of Ni, Cr, Fe and Al is ≥70% and ≤95.8%, and the sum of the atomic percentages of all the components is 100%. The multicomponent alloys prepared by the methods exhibit face-cantered cubic matrix and possess high strength and good ductility; further, they have high resistivity and excellent resistivity stability in wide temperature ranges below 773 K.

9 Claims, 10 Drawing Sheets

HIGH-STRENGTH AND DUCTILE MULTICOMPONENT PRECISION RESISTANCE ALLOYS AND FABRICATION METHODS THEREOF

FIELD OF THE INVENTION

The present invention generally relates to the technical field of metallic material preparations. More specifically, the present invention relates to high-strength and ductile multicomponent precision resistance alloys and fabrication methods thereof.

BACKGROUND OF THE INVENTION

Resistance alloys can be divided into precision resistance alloys, resistance alloys for sensors, and electrothermal alloys based on different applications. High resistance alloys are generally resistance alloys with resistivity higher than 100 μΩ·cm. Precision resistance alloys require a high level of precision in resistance, time stability and temperature stability. High-resistivity precision resistance alloys refer to precision resistance alloys with high resistivity (higher than 100 μΩ·cm) and low temperature coefficient of resistivity. Resistance alloys for sensors are often used as strain gauges for measuring stress from low to high temperature, such as constantan alloys. Electrothermal alloys convert electric energy into heat energy, and are mainly used in fields like electric heating elements in household appliances and industrial furnaces. With the development of miniaturization and integration of electronic devices, the requirements for resistance alloys are getting higher and higher. High-strength and ductile alloys with high resistivity and low temperature coefficient of resistivity are in great demand.

However, most of the traditional precision resistance alloys contain rare earth elements with high cost. Although Fe—Cr—Al alloys exhibit high resistivity and low temperature coefficient of resistivity, they are brittle with poor plasticity and poor toughness, which limits the machinability. They also show limited high-temperature strength and low creep resistance. Despite that the nickel-chromium and nickel-chromium-iron alloys exhibit excellent high-temperature strength and good plasticity than other types of electrothermal alloy, they have low resistivity and are costly. In other words, the development of highly stable and precise resistance alloys for applications in wide temperature ranges with good machinability remains a big challenge.

Multicomponent high-entropy alloys, containing four or more principal elements (the content of each component ranges between 5-35 at. %), have become more important in recent years due to excellent comprehensive properties. In the lattice of multicomponent high-entropy alloys, each atom is surrounded by different kinds of atoms inducing lattice distortion and stress field. Further, the lattice distortion of high entropy alloys is usually higher than that of conventional alloys. The lattice distortion significantly influences dislocation mobility and the conduction of electrons and phonons in the lattice etc., further impacting the mechanical and physical properties of the alloys and rendering them to be characterized with high resistivity and low temperature coefficient of resistivity.

For example, Kao et al [J. Alloys Compd. 509 (2011) 0-1614.] reported that $Al_{0.25}CoCrFeNi$ high-entropy alloys can maintain a high and stable resistivity of 220-240 μΩ·cm in the temperature range between 4.2-300 K. Chen et al [AIP Adv. 2 (2012) 012111.] indicated that the temperature coefficient of resistivity of the $Al_{2.08}CoCrFeNi$ high-entropy alloy is only 72 ppm/K in the temperature range between 4.2-360 K, much lower than that of traditional alloys. However, these high-entropy alloys exhibit low plasticity and poor machinability [J. Mater. Eng. Perform. 24 (2015) 3077-3083].

In addition, previous investigations on the resistivity and temperature coefficient of resistivity of high-entropy resistance alloys are mainly constrained in the temperature range from 4 K to 400 K. High-strength and ductile high-entropy resistance alloys with high resistivity and low temperature coefficient of resistivity in wide temperature ranges have not been reported yet. In summary, the development of high-strength and ductile precision resistance alloys with high resistivity and low temperature coefficient of resistivity in wide temperature ranges from low temperature to high temperature is still facing severe technical obstacles.

SUMMARY OF THE INVENTION

The purpose of this section is to outline some aspects of embodiments of the present invention and briefly describe some preferred embodiments. Some simplifications or omissions may be made in this section, as well as in the abstract and title of this application, to avoid obscuring the purposes of this section, the abstract and title. Such simplifications or omissions should not be used to limit the scope of the present invention.

In view of the above and/or deficiencies in the prior art, it is an objective of the present invention to provide a type of high-strength and ductile multicomponent precision resistance alloys and the associate fabrication methods to solve the current technical issues of poor ductility, low resistivity and limited stability of resistivity in most of the existing resistance alloys.

In accordance with a first aspect of the present invention, the present invention provides a type of high-strength and ductile multicomponent precision resistance alloys, which have the characteristics of high strength and ductility, high resistivity and low temperature coefficient of resistivity in wide temperature ranges.

The term of "high-strength and ductile" used herein refers to the alloys of the present invention, which have yield strength in the range from 300 MPa to 900 MPa, ultimate tensile strength in the range from 700 MPa to 1200 MPa, and total elongation in the range from 30% to 70%. The term of "high resistivity" used herein refers to the alloys of the present invention with resistivity between 120 μΩ·cm to 160 μΩ·cm. Further, the term of "low temperature coefficient of resistivity in wide temperature ranges" used herein refers to the alloys of the present invention, which have temperature coefficient of resistivity between +300 ppm/K to −300 ppm/K in wide temperature ranges below 773 K.

In accordance with one embodiment of the present invention, the high-strength and ductile multicomponent precision resistance alloy includes the following components by atomic percentage: 45-60% of Ni, 15-30% of Cr, 5-20% of Fe, 5-15% of Al, 3-5% of Mn, 0.2-3% of Cu, and 1-5% of Si; the sum of the atomic percentage of Ni, Cr, Fe and Al is ≥70% and ≤95.8%; the sum of the atomic percentage of Mn, Cu and Si is ≥4.2% and ≤13%; and the sum of the atomic percentage of all components is 100%.

In one embodiment, the composition of the alloy of the present invention may be, but not limited to, 55% of Ni, 20% of Cr, 10% of Fe, 8% of Al, 4% of Mn, 1% of Cu and 2% of Si; or 50% of Ni, 26% of Cr, 12% of Fe, 5.5% of Al, 4% of Mn, 0.5% of Cu and 2% of Si.

In one embodiment, the alloy of the present invention has a yield strength ranging from 300 MPa to 900 MPa, an ultimate tensile strength ranging from 700 MPa to 1200 MPa, and a total elongation from 30% to 70%. In another embodiment, the alloy of the present invention has a resistivity between 120 μΩ·cm to 160 μΩ·cm and a temperature coefficient of resistivity between +300 ppm/K to −300 ppm/K in a wide temperature range below 773 K.

In accordance with a second aspect of the present invention, a method of preparing the high-strength and ductile multicomponent precision resistance alloys is provided. The method includes the following steps:

batching the alloy components according to atomic percentage;

melting all the components together with a vacuum or noble gas protection to form an as-cast alloy ingot;

hot-rolling, homogenization, cold-rolling, annealing and aging the as-cast alloy ingot to obtain an alloy block.

The term of "batching the alloy components according to atomic percentage" used herein refers to batching each component of the alloy according to a specifically designed atomic percentage. The raw materials are pure metals with a purity not less than 99%.

The term of "melting" used herein refers to a pyrometallurgical process of putting mixed pure metals into a heating furnace to melt and produce alloys, and the process can be carried out by using existing equipment such as blast furnace melting, reverberatory furnace melting, electric furnace melting and levitation melting.

The term of "hot-rolling" used herein refers to a rolling process carried out at a temperature above recrystallization temperature, which can be conducted by existing hot-rolling equipment.

The term of "homogenization" used herein refers to heating an alloy at high temperature for a long time to induce the sufficient diffusion of the chemical components inside the alloy, and the existing batch homogenization furnace or continuous homogenization furnace can be used for homogenization.

The term of "cold-rolling" used herein refers to a rolling process carried out at a temperature below recrystallization temperature, which can be conducted by existing cold-rolling equipment.

The term of "annealing" used herein refers to heating a metal slowly to a certain temperature and holding for a sufficient time, and then cooling the metal at an appropriated speed. Annealing may be carried out by recrystallization annealing, incomplete annealing, isothermal annealing, homogenized annealing, spheroidizing annealing or relief-stress annealing.

The term of "aging" used herein refers to a heating treatment, placing an alloy at a relatively high temperature or at room temperature to change/modify the properties, shape or size of it with time.

In one embodiment, the melting is conducted at a temperature between 1623-2473 K.

In one embodiment, the melting is carried out at a furnace with a vacuum degree maintained at 1-0.0001 Pa or noble gas pressure at 0.000001-5 MPa.

In accordance with another embodiment of the present invention, the hot-rolling adopts multi-pass hot-rolling, and the hot-rolling temperature is between 1173-1473 K, the thickness reduction ratio per pass is ≤25% and the total thickness reduction ratio is 30-80%.

In one embodiment, the homogenization is performed at the temperature between 1223-1573 K for around 30-600 minutes.

In one embodiment, the cold-rolling adopts multi-pass cold-rolling, and the thickness reduction ratio per pass is ≤25% and the total thickness reduction ratio is 40-90%.

In one embodiment, the annealing is conducted at an annealing temperature between 773-1473 K for 2-600 minutes; further, the annealing is performed under a vacuum condition with a furnace having a vacuum degree between 1-0.0001 Pa or noble gas pressure between 0.000001-5 MPa.

In another embodiment, the aging treatment is carried out at an aging temperature between 573-973 K for 2-1000 hours; further, the aging treatment is performed under a vacuum condition with a furnace having a vacuum degree between 1-0.0001 Pa or noble gas condition with a gas pressure between 0.000001-5 MPa.

Compared with the prior art, the present invention has the following beneficial effects:

The multicomponent alloys provided by the present invention mainly exhibit face-centered cubic phase structure. The existence of multicomponent alloy elements makes the alloys show significant solid solution strengthening effect, ensuring high strength. The large lattice distortion makes the alloys have high resistivity and low temperature coefficient of resistivity. The combination of its excellent strength, ductility, and resistivity performance makes it usable as excellent precision resistance alloys in the fields of electronic instruments, mobile communications, aerospace and automatic control.

BRIEF DESCRIPTION OF THE DRAWINGS

In order to clearly illustrate the technical means of the embodiments of the present invention, the corresponding figures used in the description of the embodiments will be briefly introduced as below. Obviously, the following descriptions of the figures are only some embodiments of the present invention, and other figures can also be obtained according to these figures on the premise of not paying creative labor for a skilled person in the art, in which.

DETAILED DESCRIPTION

In order to make the above objects, features and advantages of the present invention more obvious and comprehensible, the specific examples of the present invention will be described in details as below in conjunction with the embodiments.

In the following description, specific details are set forth in order to fully understand the present invention, but the present invention can also be implemented in other ways. It will be apparent to those skilled in the art that modifications, including additions and/or substitutions may be made without departing from the scope and spirit of the invention. Therefore, the present invention is not limited to the specific examples disclosed as below.

Furthermore, the terms of "one embodiment" or "an embodiment" used herein refers to a specific feature, structure or characteristic that may be included in at least one implementation of the present invention. "In one embodiment" appearing in different places in this specification does not all refer to the same embodiment, nor is it a separate or selective embodiment that is mutually exclusive with other embodiments.

EXAMPLES

Example 1

(1) batching the alloy components according to atomic percentage: $Ni_{55}Cr_{20}Fe_{10}Al_8Mn_4Cu_1Si_2$, and the raw material thereof is using pure metals;

(2) melting the mixed pure metals with noble gas protection by magnetic levitation melting repeatedly for 4 times; for melting, it is first vacuumed to a vacuum degree of 0.001 Pa, and then argon gas is injected until the pressure is slightly positive, and the melting temperature is 1873 K holding for 5 minutes; further, casting into a cuboid shape and obtaining an as-cast alloy ingot;

(3) subjecting the as-cast alloy ingot to multi-pass hot-rolling, and the hot-rolling temperature is 1323 K, the thickness reduction ratio per pass is 10% and the total thickness reduction ratio is 50%;

(4) subjecting the hot-rolled alloy to a high-temperature homogenization treatment with argon protection (argon pressure is 10 Pa), and the treatment is conducted at a temperature of 1373 K for 2 hours followed by water quenching;

(5) subjecting the homogenized alloy to multi-pass room temperature cold-rolling, and the thickness reduction ratio per pass is 10% and the total thickness reduction ratio is 80%;

(6) annealing the cold-rolled alloy sheet with argon protection (argon pressure is 10 Pa), and the annealing temperature is 1223 K and the annealing time is 3 mins to obtain an annealed multicomponent alloy; and (7) slicing and aging the annealed multicomponent alloy sheet at 723 K for 72 hours to obtain a multicomponent alloy of Example 1.

Figure 1:
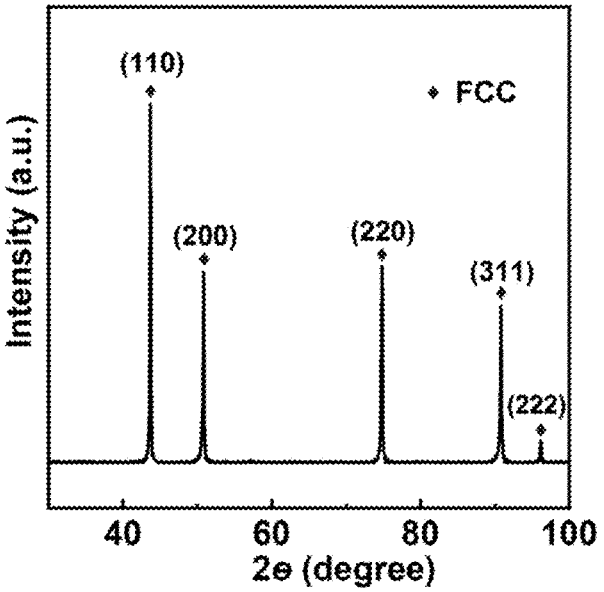
FIG. 1 depicts an XRD pattern of the multicomponent alloy obtained from Example 1 of the present invention.

The XRD pattern of the multicomponent alloy obtained from Example 1 is shown in FIG. 1. From the XRD pattern, the multicomponent alloy obtained from Example 1 mainly exhibits a face-centered cubic (FCC) solid solution structure.

Figure 2:
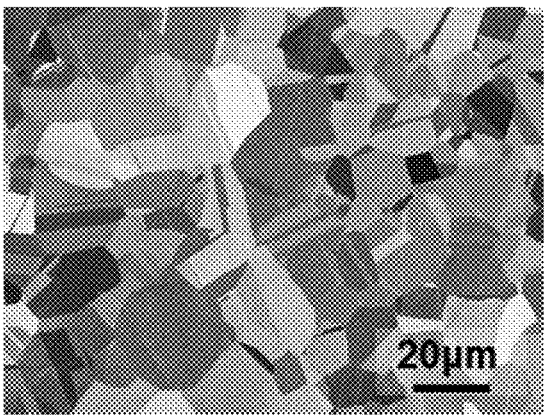
FIG. 2 depicts a scanning electron microscope image of the multicomponent alloy obtained from Example 1 of the present invention.

The scanning electron microscope image of the multicomponent alloy obtained from Example 1 is shown in FIG. 2. The multicomponent alloy obtained from Example 1 exhibits equiaxed grain morphology and has a large number of annealing twins.

Figure 3A:
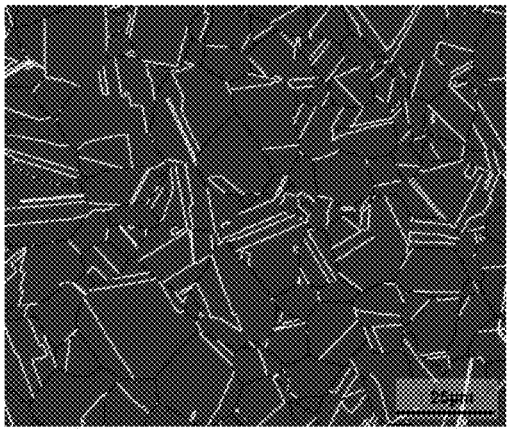
FIGS. 3A-3B depict an EBSD phase map (FIG. 3A) and an inverse pole figure (IPF) map (FIG. 3B) of the multicomponent alloy obtained from Example 1 of the present invention.
Figure 3B:
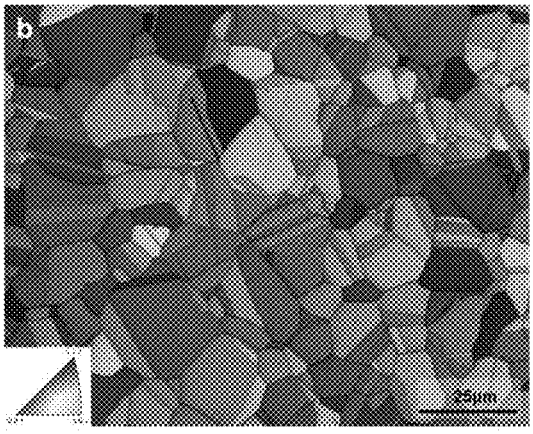

The EBSD phase map and inverse pole figure (IPF) of the multicomponent alloy obtained from Example 1 are shown in FIGS. 3A-3B, respectively. It is confirmed that the multicomponent alloy obtained from Example 1 is dominated by face-centered cubic (FCC) phase structure and there is no obvious intermetallic at micron-scale.

Figure 4:
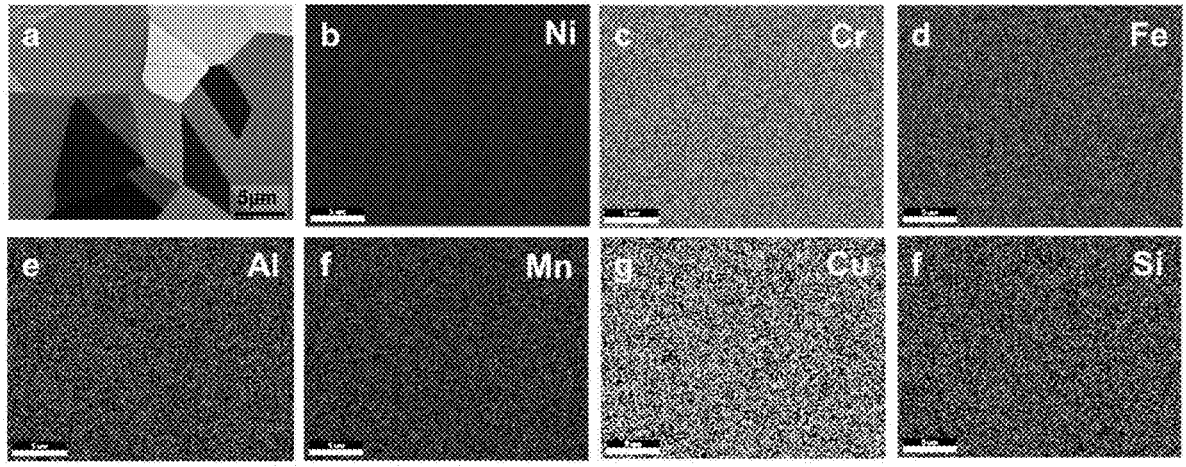
FIG. 4 shows the energy-dispersive X-ray spectroscopy map of the multicomponent alloy obtained from Example 1 of the present invention.

The energy-dispersive X-ray spectroscopy map of the multicomponent alloy obtained from Example 1 is shown in FIG. 4. Each component in the multicomponent alloy obtained from Example 1 is still uniformly distributed at micron scale, and there is no obvious element segregation at micron scale.

Figure 5A:
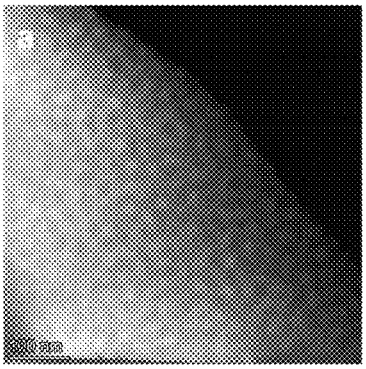
FIGS. 5A-5B show a bright-field transmission electron microscope image (FIG. 5A) and the corresponding selected area electron diffraction pattern (FIG. 5B) of the multicomponent alloy obtained from Example 1 of the present invention.
Figure 5B:
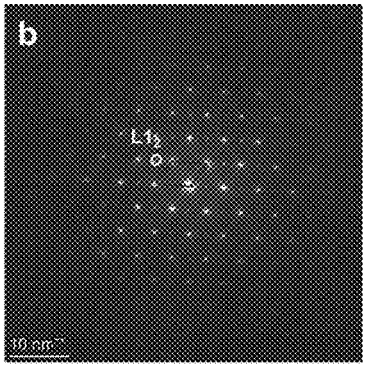

The bright-field transmission electron microscope image and the corresponding selected area electron diffraction pattern of the multicomponent alloy obtained from Example 1 are shown in FIGS. 5A-5B, respectively. There are $L1_2$ nanoprecipitates dispersed in the multicomponent alloy obtained from Example 1.

Figure 6A:
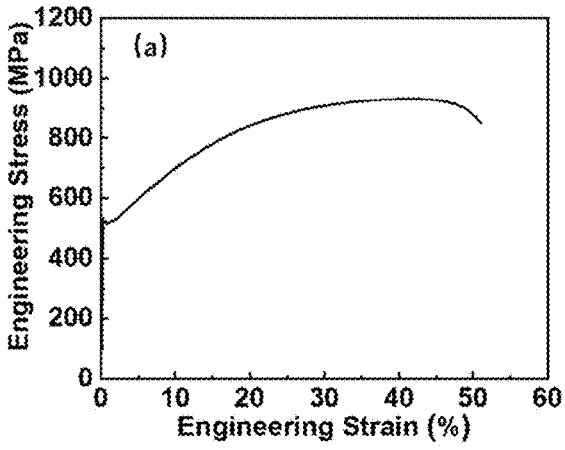
FIGS. 6A-6B depict a tensile curve (FIG. 6A) and a resistivity-temperature curve (FIG. 6B) of the multicomponent alloy obtained from Example 1 of the present invention.
Figure 6B:
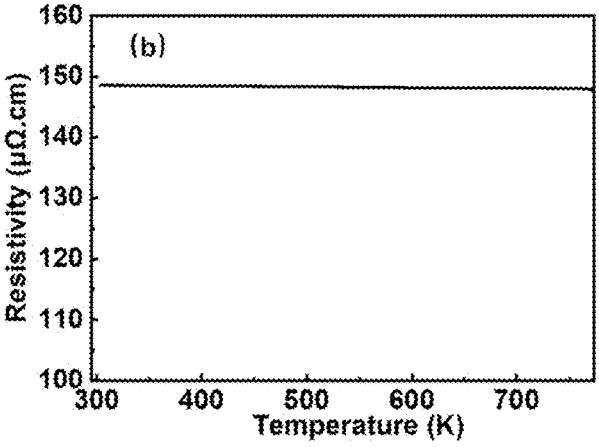

The tensile curve and resistivity-temperature curve of the multicomponent alloy obtained from Example 1 are shown in FIGS. 6A-6B, respectively. Referring to the tensile curve of FIG. 6A, the yield strength, the ultimate tensile strength and the total elongation of the multicomponent alloy obtained from Example 1 are 530 MPa, 930 MPa and 55%, respectively. Further, referring to the resistivity-temperature curve of FIG. 6B, the resistivity of the multicomponent alloy obtained from Example 1 is almost constant at 149 μΩ·cm in the temperature range below 773 K, meaning that the temperature coefficient of resistivity is nearly zero.

Example 2

(1) batching the alloy components according to atomic percentage: $Ni_{55}Cr_{20}Fe_{10}Al_8Mn_4Cu_1Si_2$, and the raw material thereof is using pure metals;

(2) melting the mixed pure metals with noble gas protection by magnetic levitation melting repeatedly for 4 times; for melting, it is first vacuumed to a vacuum degree of 0.001 Pa, and then argon gas is injected until the pressure is slightly positive, and the melting temperature is 1873 K holding for 5 minutes; further, casting into a cuboid shape and obtaining an as-cast alloy ingot;

(3) subjecting the melted alloy ingot to multi-pass hot-rolling, and the hot-rolling temperature is 1323 K, the thickness reduction ratio per pass is 10% and the total thickness reduction ration is 50%;

(4) subjecting the hot-rolled alloy to a high-temperature homogenization treatment with argon protection (argon pressure is 10 Pa), and the treatment is conducted at a temperature of 1373 K for 2 hours followed by water quenching;

(5) subjecting the homogenized alloy to multi-pass room temperature cold-rolling, and the thickness reduction ratio per pass is 10% and the total thickness reduction ratio is 80%;

(6) annealing the cold-rolled alloy sheet with argon protection (argon pressure is 10 Pa), and the annealing temperature is 1223 K and the annealing time is 3 mins to obtain an annealed multicomponent alloy; and (7) slicing and aging the annealed multicomponent alloy block at 723 K for 240 hours to obtain a multicomponent alloy of Example 2.

Figure 7:
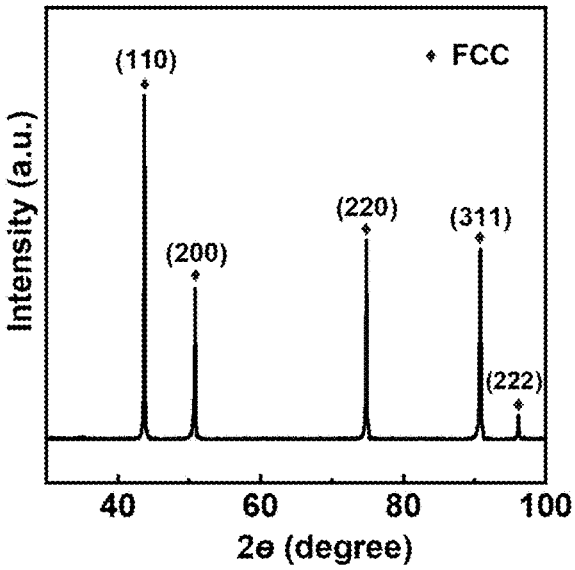
FIG. 7 is an XRD pattern of the multicomponent alloy obtained from Example 2 of the present invention.

The XRD pattern of the multicomponent alloy obtained from Example 2 is shown in FIG. 7. From the XRD pattern, the multicomponent alloy obtained from Example 2 mainly exhibits face-centered cubic (FCC) phase structure.

Figure 8A:
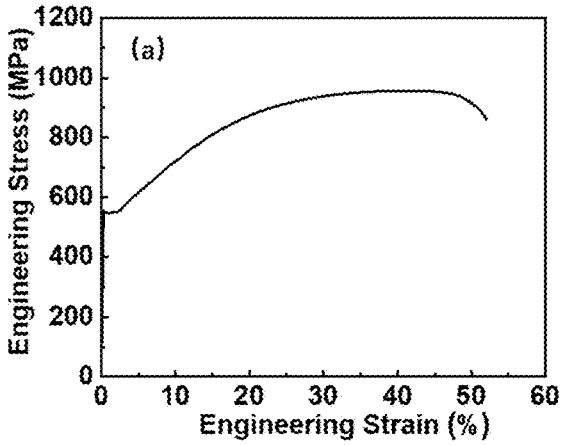
FIGS. 8A-8B depict a tensile curve (FIG. 8A) and a resistivity-temperature curve (FIG. 8B) of the multicomponent alloy obtained from Example 2 of the present invention.
Figure 8B:
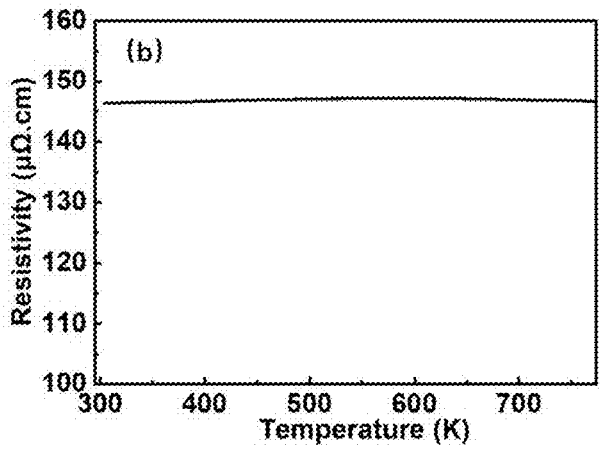

The tensile curve and resistivity-temperature curve of the multicomponent alloy obtained from Example 2 are shown in FIGS. 8A-8B, respectively. Referring to the tensile curve shown in FIG. 8A, the yield strength, the ultimate tensile strength and the total elongation of the multicomponent alloy obtained from Example 2 are 550 MPa, 960 MPa and 55%, respectively. Further, referring to the resistivity-temperature curve of FIG. 8B, the resistivity of the multicomponent alloy obtained from Example 2 is almost constant at 147 μΩ·cm in the temperature range below 773 K, meaning that the temperature coefficient of resistivity is nearly zero.

Example 3

(1) batching the alloy components according to atomic percentage: $Ni_{55}Cr_{20}Fe_{10}Al_8Mn_4Cu_1Si_2$, and the raw material thereof is using pure metals;

(2) melting the mixed pure metals with noble gas protection by magnetic levitation melting repeatedly for 4 times; for melting, it is first vacuumed to a vacuum degree of 0.001 Pa, and then argon gas is injected until the pressure is slightly positive, and the melting temperature is 1873 K sustained to 5 minutes; further, casting into a cuboid shape and obtaining an as-cast alloy ingot;

(3) subjecting the melted alloy ingot to multi-pass hot-rolling, and the hot-rolling temperature is 1323 K, the thickness reduction ratio per pass is 10% and the total rolling reduction is 50%;

(4) subjecting the hot-rolled alloy block to a high-temperature homogenization treatment with argon protection (argon pressure is 10 Pa), and the treatment is conducted at a temperature of 1373 K for 2 hours followed by water quenching;

(5) subjecting the homogenized alloy to multi-pass room temperature cold-rolling, and the thickness reduction ratio per pass is 10% and the total thickness reduction ratio is 80%;

(6) annealing the cold-rolled alloy sheet with argon protection (argon pressure is 10 Pa), and the annealing temperature is 1223 K and the annealing time is 3 mins to obtain an annealed multicomponent alloy; and (7) slicing and aging the annealed multicomponent alloy block at 833 K for 10 hours to obtain a multicomponent alloy of Example 3.

Figure 9:
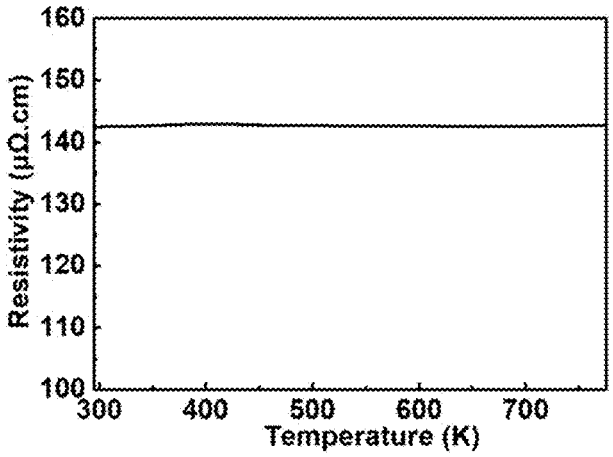
FIG. 9 is a resistivity-temperature curve of the multicomponent alloy obtained from Example 3 of the present invention.

The resistivity-temperature curve of the multicomponent alloy obtained from Example 3 is shown in FIG. 9. The resistivity of the multicomponent alloy obtained from Example 3 is nearly constant at 142 μΩ·cm in the temperature range below 773 K, meaning that the temperature coefficient of resistivity is nearly zero.

Example 4

(1) batching the alloy components according to atomic percentage: $Ni_{55}Cr_{20}Fe_{10}Al_8Mn_4Cu_1Si_2$, and the raw material thereof is using pure metals;

(2) melting the mixed pure metals with noble gas protection by magnetic levitation melting repeatedly for 4 times; for melting, it is first vacuumed to a vacuum degree of 0.001 Pa, and then argon gas is injected until the pressure is slightly positive, and the melting degree is 1873 K sustained to 5 minutes; further, casting into a cuboid shape and obtaining an as-cast alloy ingot;

(3) subjecting the melted alloy ingot to multi-pass hot-rolling, and the hot-rolling temperature is 1323 K, the thickness reduction ratio per pass is 10%, and the total thickness reduction ratio is 50%;

(4) subjecting the hot-rolled alloy to a high-temperature homogenization treatment with argon protection (argon pressure is 10 Pa), and the treatment is conducted at a temperature of 1373 K for 2 hours followed by water quenching;

(5) subjecting the homogenized alloy block to multi-pass room temperature cold-rolling, and the thickness reduction ratio per pass is 10% and the total thickness reduction ratio is 80%; and (6) annealing the cold-rolled alloy sheet with argon protection (argon pressure is 10 Pa), and the annealing temperature is 1223 K and the annealing time is 3 mins to obtain a multicomponent alloy of Example 4.

Figure 10:
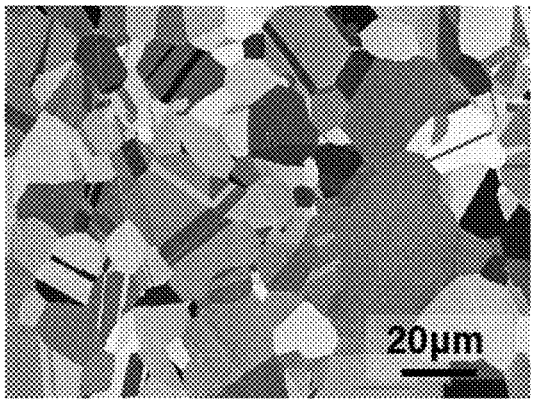
FIG. 10 is a scanning electron microscope image of the multicomponent alloy obtained from Example 4 of the present invention.

The scanning electron microscope image of the multicomponent alloy obtained from Example 4 is shown in FIG. 10. The multicomponent alloy obtained from Example 4 exhibits equiaxed grain morphology and has a large number of annealing twins.

Figure 11A:
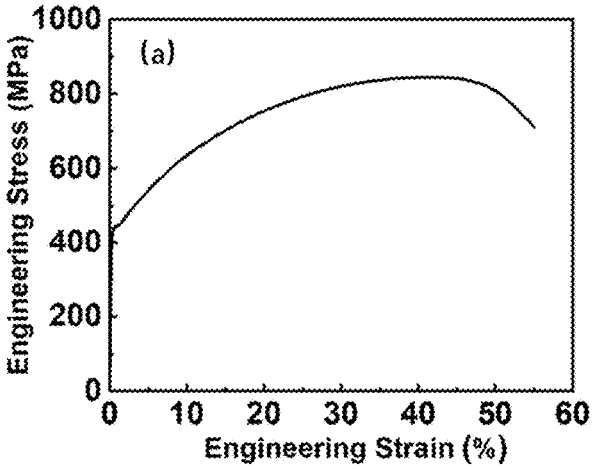
FIGS. 11A-11B depict a tensile curve (FIG. 11A) and a resistivity-temperature curve (FIG. 11B) of the multicomponent alloy obtained from Example 4 of the present invention.
Figure 11B:
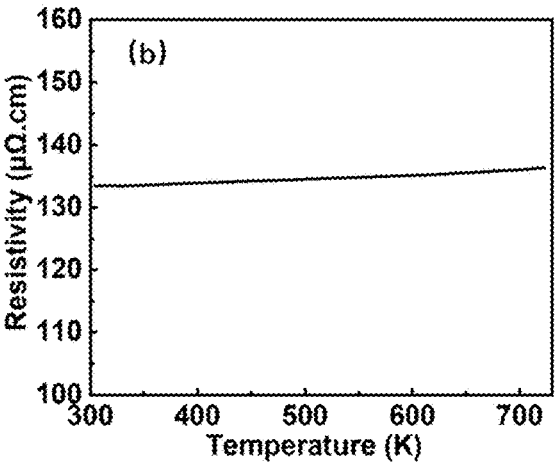

The tensile curve and resistivity-temperature curve of the multicomponent alloy obtained from Example 4 are shown in FIGS. 11A-11B, respectively. Referring to the tensile curve shown in FIG. 11A, the yield strength, the ultimate tensile strength and the total elongation of the multicomponent alloy obtained from Example 4 are 435 MPa, 840 MPa and 55%, respectively. Further, referring to the resistivity-temperature curve of FIG. 11B, the resistivities of the multicomponent alloy obtained at 303 K and 723 K from Example 4 are 133.4 μΩ·cm and 136.4 μΩ·cm respectively, meaning that the temperature coefficient of resistivity in this temperature range is 53 ppm/K.

Example 5

(1) batching the alloy components according to atomic percentage: $Ni_{50}Cr_{26}Fe_{12}Al_{5.5}Mn_4Cu_{0.5}Si_2$, and the raw material thereof is using pure metals;
(2) melting the mixed pure metals with a noble gas protection by vacuum arc melting repeatedly for 4 times; for melting, it is first vacuumed to a vacuum degree of 0.001 Pa, and then argon gas is injected until the pressure is slightly positive, and the melting temperature is 1873 K sustained to 5 minutes;
(3) subjecting the melted alloy ingot to multi-pass hot-rolling, and the hot-rolling temperature is 1323 K, the thickness reduction ratio per pass is 10%, and the total thickness reduction ratio is 50%;
(4) subjecting the hot-rolled alloy to a high-temperature homogenization treatment with an argon protection (argon pressure is 10 Pa), and the treatment is conducted at a temperature of 1473 K for 2 hours followed by water quenching;
(5) subjecting the homogenized alloy to multi-pass room temperature cold-rolling, and the thickness reduction ratio per pass is 10% and the total thickness reduction ratio is 70%;
(6) annealing the cold-rolled alloy sheet with an argon protection (argon pressure is 10 Pa), and the annealing temperature is 1223 K and the annealing time is 3 mins to obtain an annealed multicomponent alloy; and
(7) slicing and aging the annealed multicomponent alloy at 723 K for 72 hours to obtain a multicomponent alloy of Example 5.

Figure 12:
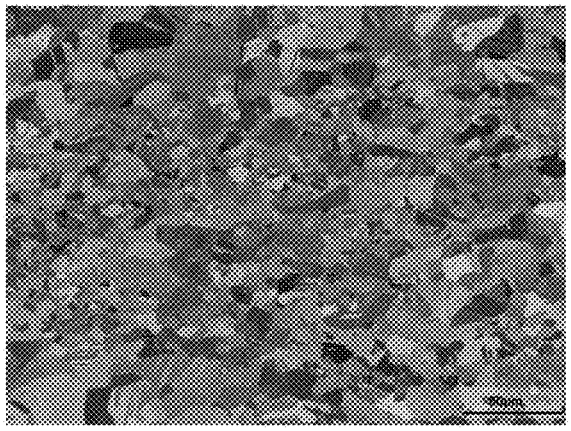
FIG. 12 is a scanning electron microscope image of the multicomponent alloy obtained from Example 5 of the present invention.

The scanning electron microscope image of the multicomponent alloy obtained from Example 5 is shown in FIG. 12. The multicomponent alloy obtained from Example 5 exhibits equiaxed grain morphology and has a large number of annealing twins.

Figure 13A:
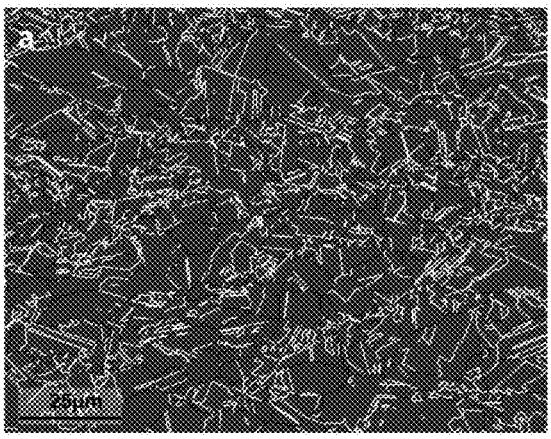
FIGS. 13A-13B show an EBSD phase map (FIG. 13A) and an inverse pole figure (IPF) map (FIG. 13B) of the multicomponent alloy obtained from Example 5 of the present invention.
Figure 13B:
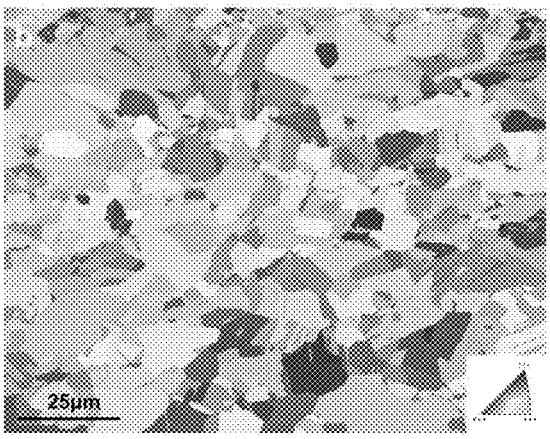

The EBSD phase map and inverse pole figure (IPF) of the multicomponent alloy obtained from Example 5 are shown in FIGS. 13A-13B, respectively. It is confirmed that the multicomponent alloy obtained from Example 5 is dominated by face-centered cubic (FCC) phase structure and there is no obvious intermetallic at micron-scale.

Figure 14:
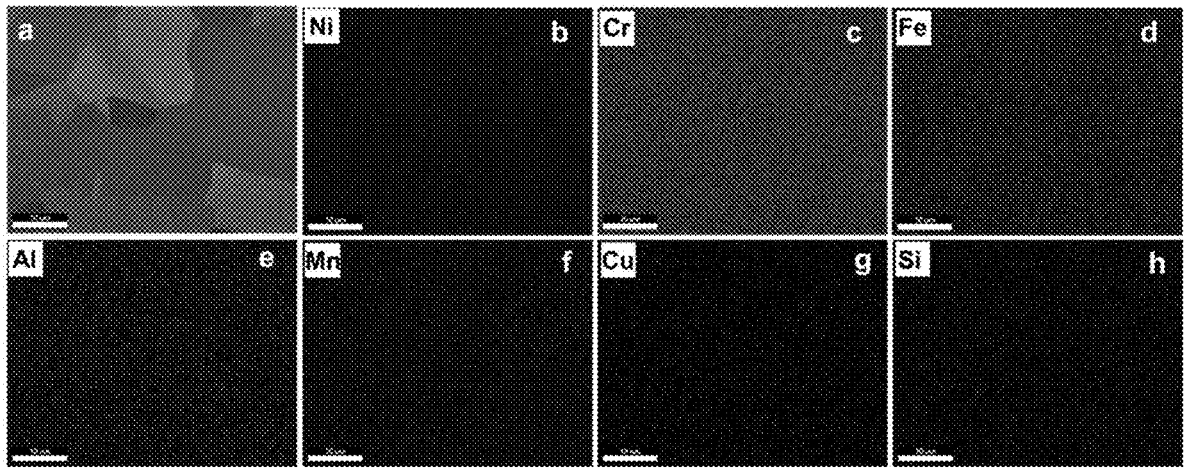
FIG. 14 is the energy-dispersive X-ray spectroscopy map of the multicomponent alloy obtained from Example 5 of the present invention.

The energy-dispersive X-ray spectroscopy map of the multicomponent alloy obtained from Example 5 is shown in FIG. 14. Each component in the multicomponent alloy obtained from Example 1 is still uniformly distributed at micron scale, and there is no obvious element segregation shown at micron scale.

Figure 15A:
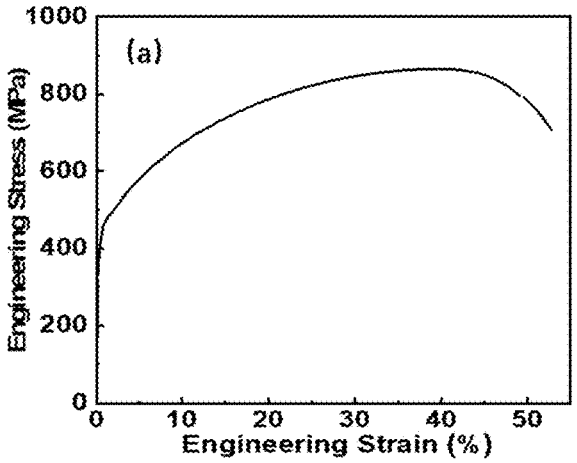
FIGS. 15A-15B show a tensile curve (FIG. 15A) and a resistivity-temperature curve (FIG. 15B) of the multicomponent alloy obtained from Example 5 of the present invention.
Figure 15B:
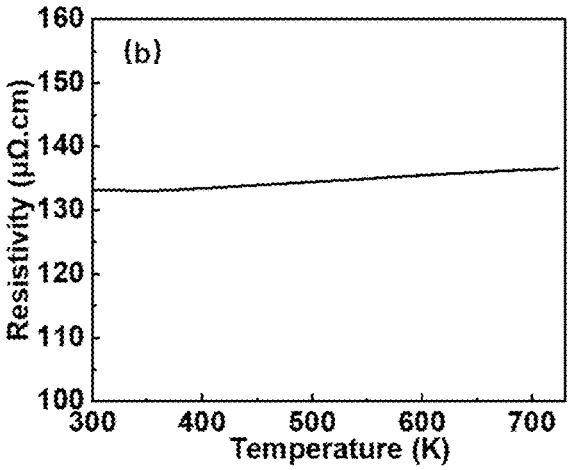

The tensile curve and resistivity-temperature curve of the multicomponent alloy obtained from Example 4 are shown in FIGS. 15A-15B, respectively. Referring to the tensile curve shown in FIG. 15A, the yield strength, ultimate tensile strength and the total elongation of the multicomponent alloy obtained from Example 5 are 405 MPa, 860 MPa and 53%, respectively. Further, referring to the resistivity-temperature curve of FIG. 15B, the resistivities of the multicomponent alloy obtained at 301 K and 723 K are 133.2 μΩ·cm and 136.6 μΩ·cm respectively, meaning that the temperature coefficient of resistivity in this temperature range is 63 ppm/K.

Example 6

(1) batching the alloy components according to atomic percentage: $Ni_{50}Cr_{26}Fe_{12}Al_{5.5}Mn_4Cu_{0.5}Si_2$, and the raw material thereof is using pure metals;
(2) melting the ingredients with noble gas protection by vacuum arc melting repeatedly for 4 times; for melting, it is vacuumed to a vacuum degree of 0.001 Pa, and then argon gas is injected until the pressure is slightly positive, and the melting temperature is 1873 K sustained to 5 minutes;
(3) subjecting the melted alloy ingot to multi-pass hot-rolling, and the hot-rolling temperature is 1323 K, the thickness reduction ratio per pass is 10%, and the total thickness reduction ratio is 50%;
(4) subjecting the hot-rolled alloy to a high-temperature homogenization treatment with an argon protection (argon pressure is 10 Pa), and the treatment is conducted at a temperature of 1473 K for 2 hours followed by water quenching;
(5) subjecting the homogenized alloy to multi-pass room temperature cold-rolling, and the thickness reduction ratio per pass is 10% and the total thickness reduction ratio is 70%; and
(6) annealing the cold-rolled alloy sheet with an argon protection (argon pressure is 10 Pa), and the annealing temperature is 1223 K and the annealing time is 3 mins to obtain a multicomponent alloy of Example 6.

Figure 16:
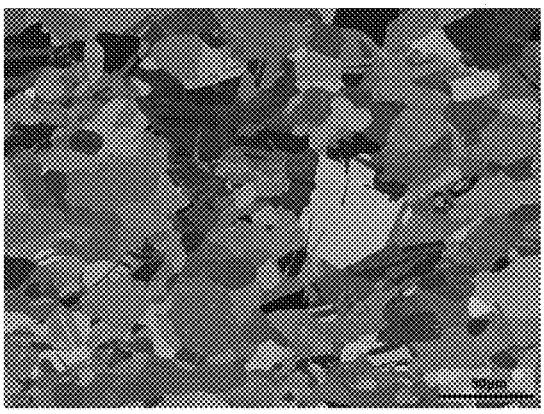
FIG. 16 is a scanning electron microscope image of the multicomponent alloy obtained from Example 6 of the present invention.

The scanning electron microscope image of the multicomponent alloy obtained in Example 6 is shown in FIG. 16. The multicomponent alloy obtained in Example 1 exhibits equiaxed grain morphology and has a large number of annealing twins.

Figure 17A:
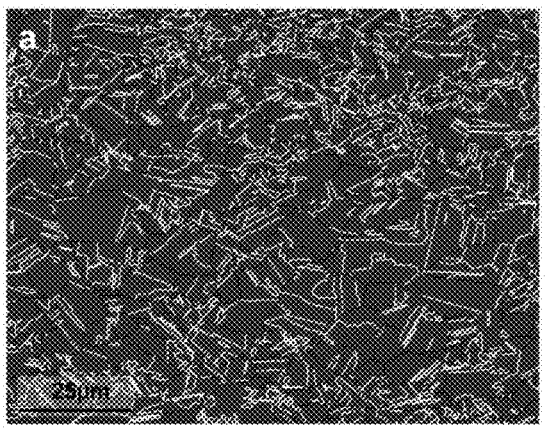
FIGS. 17A-17B depict an EBSD phase map (FIG. 17A) and an inverse pole figure (IPF) map (FIG. 17B) of the multicomponent alloy obtained from Example 6 of the present invention.
Figure 17B:
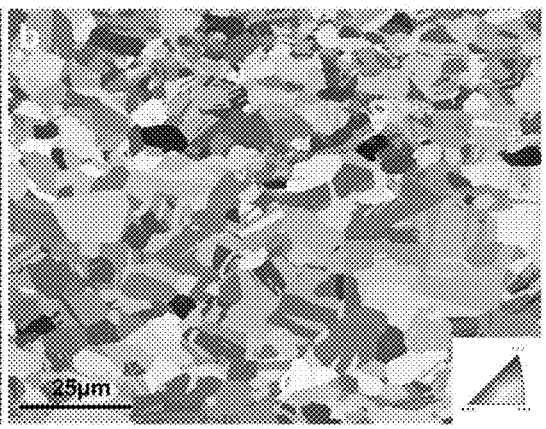

The EBSD phase map and inverse pole figure (IPF) of the multicomponent alloy obtained from Example 5 are shown in FIGS. 17A-17B, respectively. It is confirmed that the multicomponent alloy obtained from Example 6 is dominated by face-centered cubic (FCC) phase structure and there is no obvious intermetallic at micron-scale.

Figure 18A:
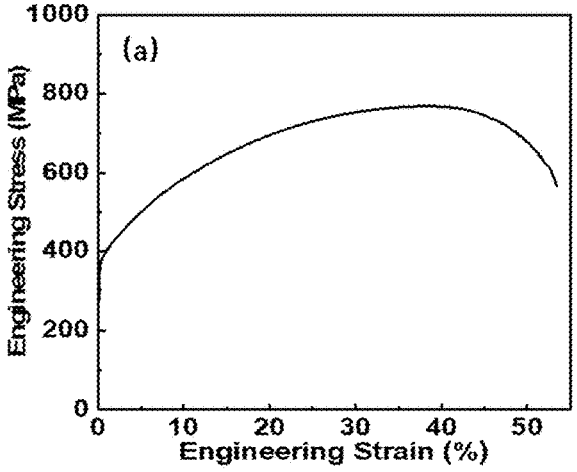
FIGS. 18A-18B depict the tensile curve (FIG. 18A) and resistivity-temperature curve (FIG. 18B) of the multicomponent alloy obtained from Example 6 of the present invention.
Figure 18B:
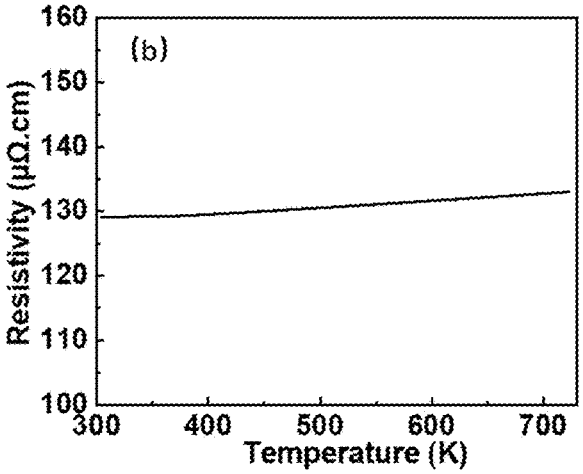

The tensile curve and resistivity-temperature curve of the multicomponent alloy obtained from Example 6 are shown in FIGS. 18A-18B, respectively. Referring to the tensile curve shown in FIG. 18A, the yield strength, ultimate tensile strength, and the total elongation of the multicomponent alloy obtained from Example 6 are 370 MPa, 765 MPa and 53%, respectively. Further, referring to the resistivity-temperature curve of FIG. 18B, the resistivities of the multicomponent alloy obtained at 303 K and 723 K from Example 6 are 129 μΩ·cm and 133 μΩ·cm respectively, meaning that the temperature coefficient of resistivity in this temperature range is 74 ppm/K.

Comparing Examples 1 and 2, it can be summarized that the long-term aging treatment at 723 K can form precision resistance alloys with high strength, good ductility, high resistivity, and an extremely low temperature coefficient of resistivity. Comparing Examples 2 and 3, it is shown that resistance alloys with relatively high and stable resistivity can be obtained by aging at a slightly higher temperature (at 833 K) for a shorter time (10 h). Compared with the annealed alloys in Example 4, the aged alloys in Examples 1, 2, and 3, exhibit significantly higher resistivity, lower temperature coefficient of resistivity, enhanced strength and good ductility. Comparing alloys in Examples 5 and 6 which have the same compositions, it is noted that the aging treatment can significantly increase the resistivity, reduce the temperature coefficient of resistivity and strengthen the alloys while maintaining good ductility. Comparing Examples 1 and 5 that both of them have been treated with the same aging process, it is shown that appropriately increasing the contents of alloying elements can enhance the resistivity, reduce the temperature coefficient of resistivity and promote the strength of the alloys.

Comparative Example 1

Figure 19:
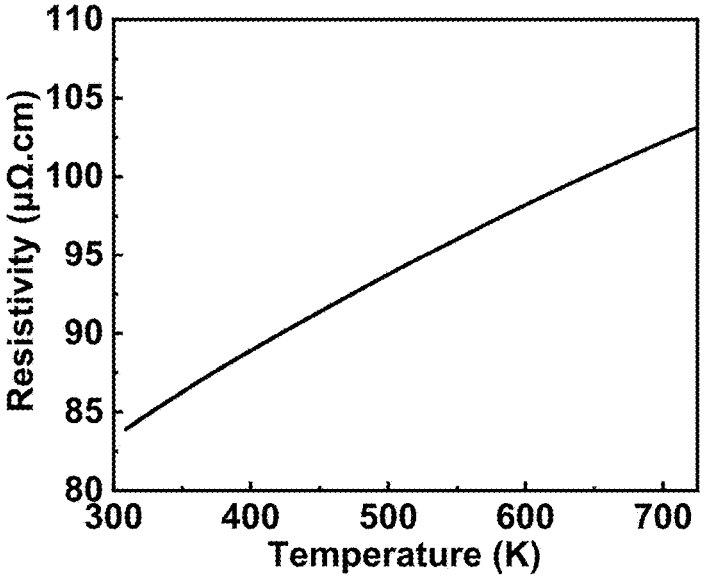
FIG. 19 is a resistivity-temperature curve of the alloy obtained from Comparative Example 1.

As shown in FIG. 19, the resistivity-temperature curve of the alloy with a chemical composition of $Fe_{40}Ni_{20}Co_{20}Cr_{20}$ (atomic percentage) is measured. The comparative alloy is prepared based on the atomic percentage of each component and melted by vacuum arc melting with noble gas protection repeatedly for 4 times. Briefly, it is vacuumed to a vacuum degree of 0.001 Pa, and then argon gas is injected until the pressure is slightly positive, and the melting temperature is 1873 K. The cast alloy is subjected to multi-pass hot-rolling treatment, wherein the hot-rolling temperature is 1173 K, the thickness reduction ratio per pass is 10% and the total thickness reduction ratio is 50%. Further, the hot-rolled alloy is subjected to a high temperature homogenization treatment at a temperature of 1473 K with argon protection (argon pressure is 10 Pa) for 2 hours followed by water quenching to obtain the comparative alloy. As shown in FIG. 19, the alloy has resistivity of 84 μΩ·cm and 103 μΩ·cm at 309 K and 723 K, respectively, and the temperature coefficient of resistivity in this temperature range is around 546 ppm/K.

Comparative Example 2

Figure 20:
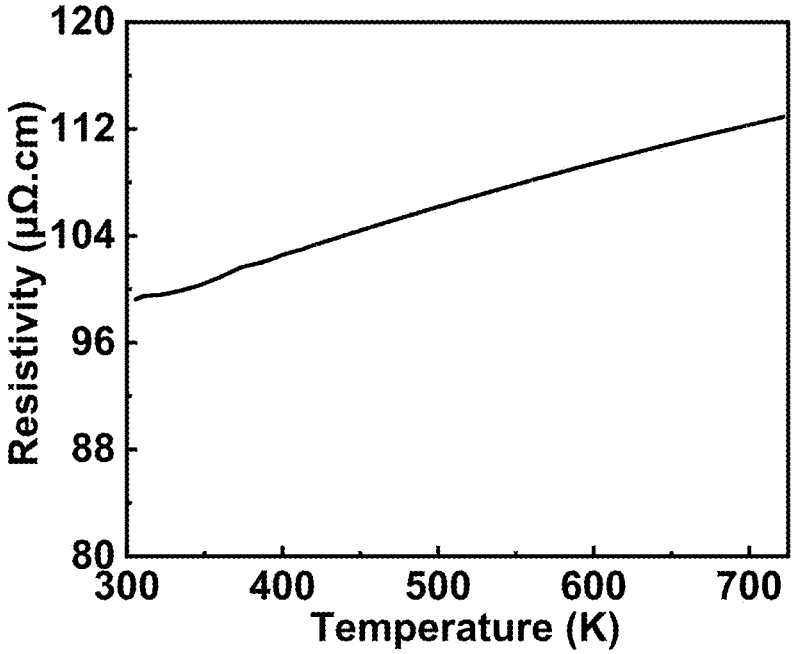
FIG. 20 is a resistivity-temperature curve of the alloy obtained from Comparative Example 2.

As shown in FIG. 20, the resistivity-temperature curve of the equiatomic FeNiCr alloy is measured. The comparative alloy is prepared according to the atomic percentage of each component and melted by vacuum arc melting with noble gas protection repeatedly for 4 times. Briefly, it is vacuumed to a vacuum degree of 0.001 Pa, and then argon gas is injected until the pressure is slightly positive, and the melting temperature is 1873 K. The cast alloy is subjected to multi-pass hot-rolling treatment, wherein the hot-rolling temperature is 1223 K, the thickness reduction ratio per pass is 10% and the total thickness reduction ratio is 50%. Further, the hot-rolled alloy is subjected to a high temperature homogenization treatment at 1473 K with argon protection (argon pressure is 10 Pa) for 2 hours followed by water quenching. Furthermore, the homogenized alloy is subjected to multi-pass room temperature cold-rolling treatment, wherein the thickness reduction ratio per pass is 10% and the total thickness reduction ratio is 60%. After that, the cold-rolled alloy is annealed with argon protection (argon pressure is 10 Pa), wherein the annealing temperature is 1273 K and the annealing time is 60 minutes, to obtain the comparative alloy. As shown in FIG. 20, the alloy has resistivity of 99 μΩ·cm at 306 K and 113 μΩ·cm at 723 K, respectively, and the temperature coefficient of resistivity in this temperature range is around 339 ppm/K.

Comparing Examples 1, 2, 3, 4, 5 with Comparative Example 1, it can be seen that the resistivity of the alloy prepared by the present invention is higher than that of the $Fe_{40}Ni_{20}Co_{20}Cr_{20}$ (atomic percent) alloy and the temperature coefficient of resistivity is lower. Further comparing Examples 1, 2, 3, 4, 5 with Comparative Example 2, it is also shown that the alloys prepared by the present invention exhibit higher resistivity and lower temperature coefficient of resistivity compared with that of the equiatomic FeNiCr alloy.

The multicomponent alloys provided by the present invention have the following characteristics in terms of compositions: (1) compared with the traditional resistance alloys, the present alloys do not contain rare metal elements, which can effectively reduce the cost and develop environmentally friendly precision resistance alloys; (2) compared with the traditional nickel-chromium type resistance alloys, the content of Ni element in the present alloys are significantly reduced. Simultaneously, alloying elements such as Al, Mn, Cu, Si are further introduced. Since the atomic radii of Al, Si, Mn, and Cu are quite different from those of Ni, Cr, and Fe, large lattice distortions are generated in the face-centered cubic matrix which hinder dislocation movement. The enhanced solid solution strengthening effect and lattice scattering effect resulting in improving strength and resistivity and reducing the temperature coefficient of resistivity. Through the above technical means, the goals of obtaining high strength and good ductility, high resistivity, and low temperature coefficient of resistivity in wide temperature ranges are achieved.

The comprehensive effects of introducing Al, Mn, Cu, and Si alloying elements into the multicomponent alloys in the present invention are briefly described as follows: (1) Cu element promotes the formation of clusters, which is beneficial to improving strength and resistivity. Mn element can effectively reduce the temperature coefficient of resistivity; (2) the atomic radii of Al and Si (0.143 nm and 0.117 nm respectively) are quite different from those of Fe, Ni and Cr (0.124 nm, 0.125 nm and 0.125 nm respectively), which can cause large lattice distortion in the face-centered cubic matrix to hinder dislocation movement, so that the solid solution strengthening effect in the alloys can be effectively improved for strengthening the alloys, simultaneously, increasing the resistivity and reducing the temperature coefficient of resistivity.

The hot-rolling process on the alloy ingots can effectively eliminate the defects (such as micropores, microcracks, etc.) in the alloys formed during melting to improve the comprehensive performance of the alloys. The subsequent homogenization treatment can promote the sufficient diffusion of the chemical components and the formation of face-centered cubic equiaxed grain structure, and further ensure the good ductility. Although the grain sizes of the alloys are increased during the homogenization, grain refinements can be effectively achieved by subsequent cold-rolling and annealing treatments. Furthermore, the medium and low temperature aging treatment neither caused grain coarsening nor intermetallic formation.

The multicomponent alloys provided by the invention exhibit face-centered cubic matrix. The existence of multicomponent alloying elements significantly enhances the solid solution strengthening effect in the alloys and ensures high strength. The large lattice distortions provide high resistivity and low temperature coefficient of resistivity in the present alloys. Also, the combination of excellent plasticity and great resistance performance can make the high-resistivity precision resistance alloys become great candidate for the fields of electronic instruments, mobile communications, aerospace and automatic control.

It should be noted that the above embodiments are only used to illustrate the technical means of the present invention. It is not intended to be exhaustive or to limit the invention to the precise forms disclosed. Many modifications and variations will be apparent to the practitioner skilled in the art without departing from the spirit and scope of the specification.

The embodiments were chosen and described in order to best explain the principles of the invention and its practical application, thereby enabling others skilled in the art to understand the invention for various embodiments and with various modifications that are suited to the particular use contemplated.

The invention claimed is:

1. A high-strength and ductile multicomponent precision resistance alloy, consisting essentially of the following components by atomic percentage:

45-60% of Ni,
15-30% of Cr,
5-20% of Fe,
5-15% of Al,
3-5% of Mn,
0.2-3% of Cu, and
1-5% of Si;

wherein the sum of the atomic percentage of Ni, Cr, Fe and Al is ≥70% and ≤95.8%, the sum of the atomic percentage of Mn, Cu and Si is ≥4.2% and ≤13%, and the sum of the atomic percentage of all components is 100%;

wherein the alloy has a yield strength from 300 MPa to 900 MPa, an ultimate tensile strength from 700 MPa to 1200 MPa, and a total elongation from 30% to 70%, and the alloy has a resistivity between 120 μΩ·m to 160 μΩ·cm and a temperature coefficient of resistivity between +300 ppm/K to −300 ppm/K in a temperature range below 773 K, and the alloy has a face-centered cubic (FCC) phase structure.

2. A method of fabricating the alloy of claim 1, comprising:

batching each alloy component according to atomic percentage;

melting all the components together in a vacuum or noble gas protection to prepare an as-cast alloy ingot; and hot-rolling the as-cast alloy, followed by homogenization, cold-rolling, annealing and aging to obtain an alloy.

3. The method of claim 2, wherein the melting is conducted at a temperature between 1623-2473 K.

4. The method of claim 2, wherein the melting is carried out at a furnace having a vacuum degree of 1-0.0001 Pa or a noble gas condition with noble gas pressure between 0.000001-5 MPa.

5. The method of claim 2, wherein the hot-rolling is a multi-pass hot-rolling procedure with a hot-rolling temperature between 1173-1473 K, a thickness reduction ratio per pass ≤25% and a total thickness reduction ratio of 30-80%.

6. The method of claim 2, wherein the homogenization is performed at a temperature between 1223-1573 K for around 30-600 minutes.

7. The method of claim 2, wherein the cold-rolling is a multi-pass cold-rolling procedure with a thickness reduction ratio per pass ≤25% and a total thickness reduction ratio between 40-90%.

8. The method of claim 2, wherein the annealing is conducted at the temperature range from 773-1473 K for 2-600 minutes, and the annealing is performed under a vacuum condition with a vacuum degree between 1-0.0001 Pa or noble gas condition with a noble gas pressure between 0.000001-5 MPa.

9. The method of claim 2, wherein the aging treatment is carried out at an aging temperature between 573-973K for 2-1000 hours; further, the aging treatment is performed under a vacuum condition with a vacuum degree of 1-0.0001 Pa or noble gas condition with a noble gas pressure of 0.000001-5 MPa.

* * * * *